United States Patent [19]

Purtzer et al.

[11] 4,402,440

[45] Sep. 6, 1983

[54] INFANT CARRIER

[75] Inventors: Patricia K. Purtzer, 260 E. Cliff St., Solana Beach, Calif. 92075; William L. Lauer, San Diego County, Calif.

[73] Assignee: Patricia K. Purtzer, Solana Beach, Calif.

[21] Appl. No.: 266,366

[22] Filed: May 22, 1981

[51] Int. Cl.[3] ..... A47D 13/02

[52] U.S. Cl. ..... 224/160; 224/159; 224/259; 224/264

[58] Field of Search ..... 224/158, 159, 160, 161, 224/155, 259, 209, 215, 264; 297/473, 465, 467

[56] References Cited

U.S. PATENT DOCUMENTS

| | | | |
|---|---|---|---|
| 278,437 | 5/1883 | Lancaster | 224/158 |
| 1,198,423 | 9/1916 | Lude et al. | 224/161 |
| 1,535,208 | 4/1925 | Drennan | 224/158 |
| 1,616,349 | 2/1927 | Casle | 297/465 |
| 2,142,887 | 1/1939 | Dixon | 224/259 |
| 2,505,272 | 4/1950 | Blalock et al. | 224/264 X |
| 3,027,058 | 3/1962 | Huber | 224/160 X |
| 3,197,100 | 7/1965 | Thompson | 224/160 |
| 3,229,873 | 1/1966 | Hershman | 224/160 |
| 3,481,517 | 12/1969 | Aukerman | 224/160 |
| 3,780,919 | 12/1973 | Hansson | 224/160 |
| 4,009,808 | 3/1977 | Sharp | 224/160 |
| 4,037,764 | 7/1977 | Almosnino et al. | 297/467 |
| 4,226,474 | 10/1980 | Rupert et al. | 297/465 |

FOREIGN PATENT DOCUMENTS

| | | | |
|---|---|---|---|
| 476793 | 6/1915 | France | 224/160 |
| 929949 | 1/1948 | France | 224/161 |

*Primary Examiner*—Allan N. Shoap
*Attorney, Agent, or Firm*—Brown & Martin

[57] ABSTRACT

An infant carrier with a detachable diaper type pouch. A harness with a vest type panel mounts on the trunk of the carrying person, either front or back, by means of shoulder and waist straps. An infant is placed in a pouch and the pouch is fastened to the harness. The pouch can be fastened to or removed from the harness without disturbing the shoulder and waist straps. The harness preferably has shoulder and dribble pads, and the pouch preferably provides head support for the infant. Both harness and pouch can be adjusted to suit person and infant respectively.

3 Claims, 4 Drawing Figures

INFANT CARRIER

BACKGROUND OF INVENTION

This invention relates to child and infant carriers and baby packs.

The prior art related to this invention presents a wide variety of devices which enable a person to carry an infant or a small child by means of a shoulder harness. U.S. Pat. Nos. 3,481,517 by A. L. Aukerman and 4,009,808 by Andrea H. Sharp represent the variety of commonly used infant carriers. They are both made of flexible fabric and both have a seat pouch for seating the infant and both have shoulder straps crossed as the main support for the carriers. Other carriers present a rigid frame along with a fabric seat, much the same as conventional backpacks. Most child carriers presented are intended to be worn on the back of the person carrying the child. Others are presented as being reversible, that is that they can be worn on the front as well as the back, but they are intended primarily to be worn on the back. Carriers designed specifically for small infants are usually front-worn carriers. As will be seen, this invention has characteristics which present advantages to a person who wears the carrier in front, although the carrier is equally adaptable to be worn in the back.

The concept of carrying a child or infant on one's back derives from the fact that men throughout the ages have been able to transport heavy loads over long distances more easily when the loads were strapped to their backs than when the loads were carried any other way. Therefore, conventional backpacks are designed to transport loads over long distances. The fact that backpacks, especially loaded backpacks, are difficult and awkward to mount and dismount from one's shoulders is generally not a problem because of three reasons:

1. the load itself is generally well-secured in the backpack and is not likely to fall out of the pack during the awkward mounting and dismounting maneuvers;
2. the load itself generally requires no servicing during transit; and
3. the time involved in mounting and dismounting the pack is generally short as compared to the time spent in transporting the load because of the long distances normally involved.

The purpose and use of infant carriers is different from the purpose and use of backpacks. The purpose of an infant carrier is not confined to simply transporting the infant from one location to another; it's primary purpose is to provide mobility to the person responsible for carrying the infant. Nevertheless, many conventional carriers are fashioned after backpacks and, as a result, they too are difficult and awkward to mount and dismount from one's shoulders without assistance.

Unlike the packpack situation, the difficulty and awkwardness of mounting and dismounting a back-worn infant carrier present serious problems. The load, that is the infant, is not well secured in the carrier because all conventional carriers have open tops and the infant is not fastened therein. Therefore, there is a strong likelihood that the infant could fall out of the carrier during the awkward mounting and dismounting maneuvers. Furthermore, the load, that is the infant, normally requires servicing during transit. The servicing involves unpacking and repacking the infant for diaper changes, feedings, automobile trips, and any occasions when the infant needs special attention because it is crying or upset. Servicing also involves periodic visual checks for the well-being of the infant. Finally, the time involved in mounting and dismounting the carrier is not normally short as compared to the time spent in transporting the infant, because much shorter distances are involved than in the backpack situation.

Front worn carriers are also difficult and awkward to mount and dismount, and, in many cases, they are almost impossible to put o without assistance. As with the back-worn carriers, the difficulty and awkwardness is primarily due to the fact that the mounting and dismounting of the carrier on and from the shoulders of the wearer must take place while the infant is in the carrier unless assistance is available.

The inconveniences encountered by a person using heretofore presented carriers can best be exemplified by considering a common, if not typical, itinerary of a housewife/mother which involves transporting an infant to a grocery store, a specialty store and a dry-cleaning establishment. If each leg of the journey involved the use of an automobile, then, disregarding any of the above-mentioned servicing, there are at least three occasions when the mother must mount the carrier with infant onto her shoulders and three occasions when she must dismount them and move the infant to a car seat. The journey begins at the home when the mother transports infant and carrier (usually carrying both because of the short distance) to the car where the infant is strapped into a car seat. Upon arrival at the grocery store, the mother has several options. She can chose to carry the infant in her arms while shopping but, if she's going to need the simultaneous use of both of her hands at any time, such as for writing a check or bagging fruit, such a choice is not wise. For small infants, putting the infant in a shopping cart is not an answer. She can also chose to bring the car seat with infant into the store and put them in the shopping cart but car seats are not normally adapted for such use. They slide around in the cart and occupy too much space. The mother has a third option but that involves going through a 4-to-6 minute routine of putting the infant into a carrier and mounting the carrier on her shoulders. The process normally cannot be accomplished completely inside the car so both mother and infant must be exposed to the elements. Furthermore, a sleeping infant is usually awakened during the routine. During the hypothetical journey, this scene will take place three times. There are also three occasions when the mother comes back to the car and must remove the carrier from her shoulders (usually performed outside the car) and remove the infant from the carrier. It can be seen that, in addition to the problems associated with mounting and dismounting such carriers, they are also very inconvenient. It is therefore highly desirable to provide a carrier which eliminates such inconvenience.

This invention was conceived in response to the above-described problems. This invention worn as a front carrier completely eliminates the above-described inconveniences and all of the difficulty and awkwardness involved in mounting and dismounting conventional infant carriers. For the mother of the infant, carrying the baby in front is a more natural position because during the full term of pregnancy, the child is carried in the front of the mother's vertebrae, and the mother's body is, as a result of the pregnancy, strengthened for front-carrying. This invention can also be worn on the back, and as a back carrier it presents no more difficulty than conventional infant carriers.

Other advantages and attributes of this invention will be described hereinafter and still others will be apparent to one of ordinary skills in the pertinent art.

SUMMARY

This invention presents an infant carrier with two (2) major components, a harness and a pouch. The harness has a generally rectangular fabric panel which is strapped to the body by means of shoulder straps and waist straps. The harness has a pair of upper and lower dowel receiving rings. The pouch is the enclosure in which the infant rides. It has two leg holes and a back and head support section. The pouch is detachably engaged with the harness by means of four dowels which mate with the dowel receiving rings of the harness. The harness can be mounted on the front of the person or the back of the person depending on where the child is to be carried, either front or back respectively. It is an object of this invention to provide a two-piece infant carrier which eliminates the difficulties and awkwardness associated with the mounting and dismounting of conventional baby carriers from one's shoulders. It is a further object of this invention to provide an infant carrier which is inherently safer for the infant during mounting and dismounting maneuvers.

It is also an object of this invention to provide an infant carrier into which an infant can be easily inserted with a minimal of disturbance to the infant.

It is a further object of this invention to provide an infant carrier which can be worn as a front carrier and as a back carrier.

It is also an object of this invention to provide an infant carrier which can be converted for use as a backpack.

Other objects will become apparent upon a reading of the descriptions and claims hereinafter.

DESCRIPTION OF THE PREFERRED EMBODIMENT

Figure 3:
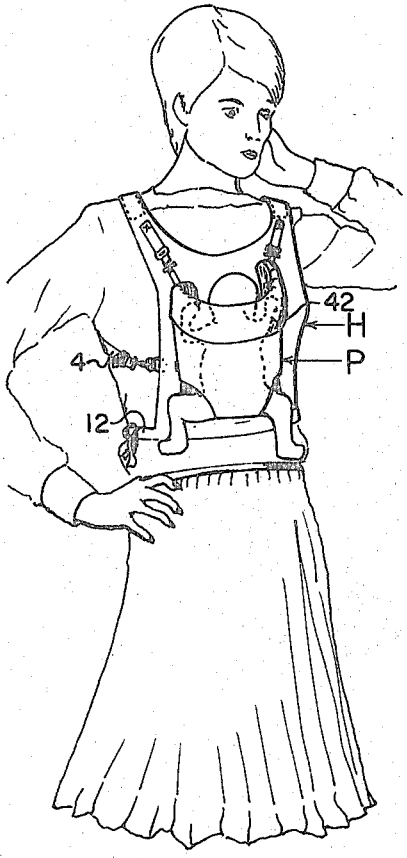
FIG. 3 is a view showing the invention being worn as a front carrier.
Figure 1:
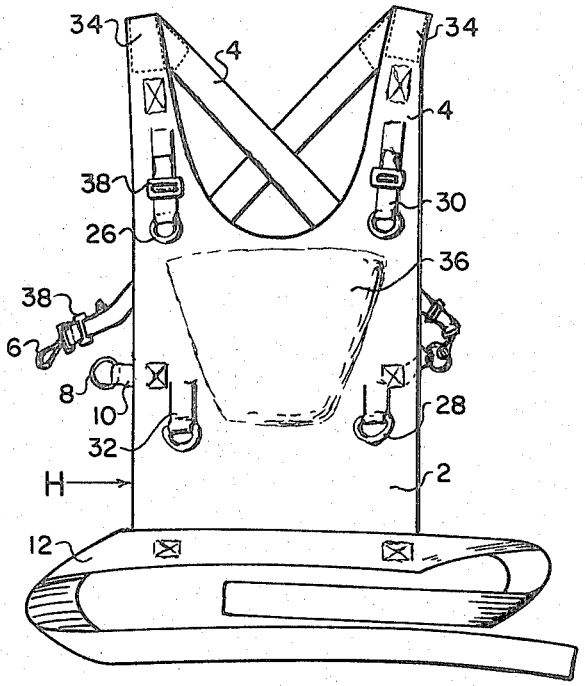
FIG. 1 is an orthogonal front view of the harness.
Figure 4:
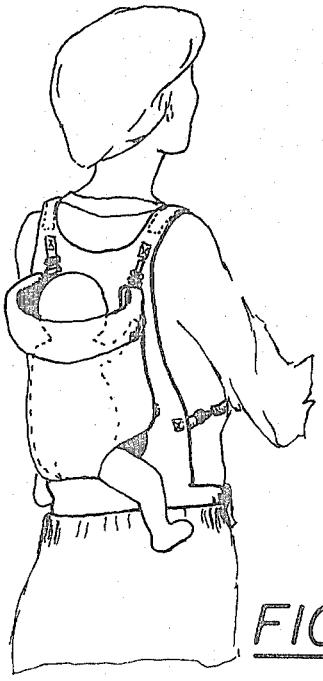
FIG. 4 is a view showing the invention being worn as a back carrier.
Figure 2:
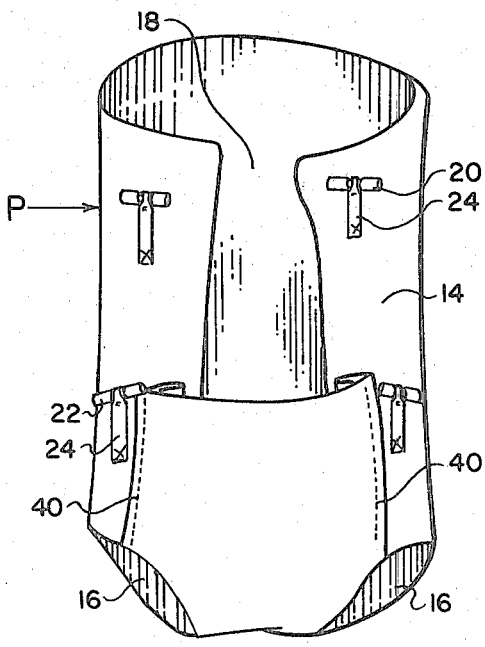
FIG. 2 is an orthogonal view of the pouch from the side which mates to the harness.

Referring to the Figures, the major components of the invention are a harness, generally designated by the letter "H" and a pouch, generally designated by the letter "P". The harness H has a fabric panel 2 which is generally rectangular in shape. Extending from the panel 2 are a pair of shoulder straps 4 normally worn in a criss-crossed fashion as shown. At the free end of each of the shoulder straps 4 is a fish hook-like safety hook 6. Each of the safety hooks 6 detachably engages with a safety hook receiving ring 8 which is connected to the panel 2 by means of a ring-retaining strap 10. The two safety hook receiving rings 8 are oppositely disposed on the sides of the panel 2 at about the mid-point of the sides. A fabric waist tie strap 12 is attached to and along the bottom of the panel 2 such that there are two legs which extend horizontally from the panel. Preferably, one leg of the waist tie strap 12 is shorter than the other leg so that when the waist tie strap 12 is tied about the waist of the wearer, the knot of the tie resides at the side of the wearer rather than in the back or front.

The pouch P is formed from a unitary piece of fabric 14 which is folded and stitched in diaper-fashion such that the back is elongated to provide a back- and head-support for the infant. The resultant shape is that of a hollow fabric cylinder with an open top, with a closed bottom except for a pair of leg openings 16 and with a slotted front opening 18. Optionally there are side openings for the arms of the infant (not shown). As previously mentioned the pouch fabric 14 is stitched in diaper-fashion utilizing a plurality of removable tucks 40 which can be selectively removed to accomodate the varying sizes of infant bottoms.

The pouch P is detachably engaged with the harness H by means of upper 20 and lower 22 fastener dowels which engage with upper 26 and lower 28 dowel receiving rings. The fastener dowels 20 and 22 are connected to the front of the pouch P by means of dowel retaining straps 24 in a rectangular pattern. The upper 26 and lower 28 dowel receiving rings are connected to the panel 2 by means of upper 30 and lower 32 dowel ring retaining straps. The location of the dowel receiving rings 26 and 28 on the harness H correspond generally to the positions of the dowel fasteners 20 and 22 on the pouch P.

The dowels are short rods of generally circular cross-section which could be manufactured from wood or a sturdy plastic which is impervious to the heat normally encountered in conventional washers and dryers, or any other suitable material. The dowels have a narrowed centered portion. The dowels are loosely secured to the free ends of the restraining straps by means of a fabric loop of suitable inner diameter so as to accomodate the narrowed centered portions of the dowels, but prevent passage therethrough of the outer portions of the dowels. The dowels engage with the dowel receiving rings in a hooked-T-fashion. Other detachable means of engaging the front of the pouch with the front of the harness may be employed without departing from the spirit of this invention. Such other means may include any combination of hooks, snaps, tie strings, and any other suitable means. It should be noted, however, that dowels are not dangerous to infants. There are no sharp edges and no crevices or openings to catch and pinch an infant's skin. They are lightweight and will not normally harm an infant if he/she is accidentally struck by a dowel. The dowels also can be easily engaged using only one hand.

There are other features of the invention which can be discussed. The portion of the shoulder straps 4 which contact and bear upon the wearer's shoulders can be fitted with foam-type shoulder pads 34. The central portion of the panel 2 which normally comes in contact with the face of the infant can be fitted with a dribble-pad 36 which is attached to the panel 2 by VELCRO-means so that the dribble pad 36 is either disposable or removable for washing. The length of the shoulder straps 4 can be made adjustable by means of slip-buckles 38 in a conventional manner. Preferably the upper dowel ring restraining straps 30 are also adjustable in length by means of slip-buckles 38 in order to permit vertical adjustment of the pouch in relation to the harness H. In order to provide a head support which is adjustable to the size of the infant the top portion of the pouch fabric 14 can be folded to provide a head support 42. The head support 42 can also be made suitably firm by an optional foam-type head pad (not shown) affixed to the top portion of the fabric pouch 14.

To illuminate the operational characteristics of this invention, please recall the previously-discussed journey of the housewife/mother. Using conventional carriers, the journey involved at least three times when the mother had to mount the carrier onto her shoulders and three times when it had to be removed from her shoulders. It can be seen from the above descriptions that, using this invention as a front carrier, the carrier harness need only be mounted and dismounted once during the entire journey. The mother disengages the pouch and mounts the harness onto her shoulders and puts the baby into the pouch preferably prior to leaving the house. From that point on neither the harness nor pouch need be removed until they have returned to the house at the conclusion of the journey. The two piece characteristic of this invention permits the mother to remove the infant from the carrier to the car seat and from the car seat to the carrier by merely disengaging and engaging, respectively, a plurality of dowel fasteners. While operating the fasteners with one hand, the infant is held by the other hand against the breast of the mother in a very natural fashion. It should be noted that the ease with which an infant is moved to and from the carrier completely eliminates the disturbances to an infant associated with heretofore presented carriers.

The preceding descriptions were given to illustrate embodiments of the inventions claimed hereinafter and no unnecessary limitations should be derived therefrom because modifications and changes known to one of ordinary skill in the pertinent art could be made without departing from the spirit of the inventions.

We claim:

1. An infant carrier for mounting on the truck portion of a carrying person's body, said infant carrier comprising:

harness means adapted to be releasably secured to the person's trunk, said harness means being shaped and configured to symmetrically distribute any weight borne by said harness means to the shoulders and upper back of the person;

compliant, infant body conformable pouch means for holding an infant, said pouch means comprising:

a body portion for supporting the back of the infant, said body portion being adapted to at least partially encircle the infant and terminating in forward flaps having edges normally spaced apart;

a seat connected to said body portion for supporting the weight of the infant;

a front panel connected to said seat portion and interconnecting said spaced flaps at the bottom of said body portion, said body and seat portions and said front panel being mutually shaped and configured to define lower openings through which the legs of the infant can extend; and fastener means on said pouch means, said fastener means comprising two first fastener means positioned on opposite sides of said pouch means adjacent said front panel and two second fastener means positioned on said flaps spaced upwardly from said respective first fastener means;

connector means on said harness means for quick release connection to said fastener means on said pouch means, whereby said pouch means supports the infant and is releasably fastenable to said harness means, the weight of said pouch means and the infant being borne by said harness means, said pouch means being adapted to support the infant in a substantially upright seated position, said quick release connector and fastener means permitting attachment of said pouch means to said harness means and detachment of said pouch means from said harness means without disturbing said harness connector means and without disturbing the infant.

2. A truck mounted infant carrier according to claim 1 wherein the harness means includes fabric panel means with shoulder strap means and waist strap means adapted to secure the panel to the trunk, and wherein the pouch means comprises a unitary piece of fabric type material which has been folded and secured diaper fashion with an elongated back portion to provide a back and head support for the infant.

3. A trunk mounted infant carrier according to claim 2 wherein the harness means is washable and further comprises a plurality of shoulder pads affixed to the shoulder straps at points where said straps bear down upon the person's shoulder.

* * * * *